US009807523B2

(12) United States Patent
Murray et al.

(10) Patent No.: US 9,807,523 B2
(45) Date of Patent: Oct. 31, 2017

(54) HEARING AID ANTENNA WITH SYMMETRICAL PERFORMANCE

(71) Applicant: Starkey Laboratories, Inc., Eden Prairie, MN (US)

(72) Inventors: Casey Edward Murray, Apple Valley, MN (US); Jay Rabel, Shorewood, MN (US)

(73) Assignee: Starkey Laboratories, Inc., Eden Prairie, MN (US)

( * ) Notice: Subject to any disclaimer, the term of this patent is extended or adjusted under 35 U.S.C. 154(b) by 0 days.

(21) Appl. No.: 15/019,885

(22) Filed: Feb. 9, 2016

(65) Prior Publication Data

US 2016/0241973 A1 Aug. 18, 2016

Related U.S. Application Data

(60) Provisional application No. 62/113,863, filed on Feb. 9, 2015.

(51) Int. Cl.

| | |
|---|---|
| ***H04R 25/00*** | (2006.01) |
| ***H01Q 1/27*** | (2006.01) |
| ***H04R 31/00*** | (2006.01) |

(52) U.S. Cl.

CPC ..... *H04R 25/554* (2013.01); *H01Q 1/273* (2013.01); *H04R 31/00* (2013.01); *H04R 2225/021* (2013.01); *H04R 2225/51* (2013.01)

(58) Field of Classification Search

CPC H04R 25/554; H04R 41/00; H04R 2225/021; H04R 2225/51; H01Q 1/2733

See application file for complete search history.

(56) References Cited

U.S. PATENT DOCUMENTS 6,008,774 A 12/1999 Wu

FOREIGN PATENT DOCUMENTS

| | | | |
|---|---|---|---|
| EP | 2200120 | A2 | 6/2010 |
| EP | 2458674 | A2 | 5/2012 |
| WO | WO-2014090419 | A1 | 6/2014 |
| WO | WO-2016130590 | A1 | 8/2016 |

OTHER PUBLICATIONS

"International Application Serial No. PCT/US2016/017208, International Search Report mailed Jun. 30, 2016", 5 pgs.

"International Application Serial No. PCT/US2016/017208, Written Opinion mailed Jun. 30, 2016", 6 pgs.

*Primary Examiner* — Tuan D Nguyen

(74) *Attorney, Agent, or Firm* — Schwegman Lundberg & Woessner, P.A.

(57) ABSTRACT

Left/Right (L/R) hearing assistance device (HA) symmetrical performance of the antenna is highly desired when using the same HA design for both the left and the right ears. Physical symmetry and loading of the antenna, both internal and external to the HA, is usually not possible because the antenna should avoid the microphone, battery, and switch locations within the HA. Described herein are antenna structures, hearing assistance devices with integrated antennas, and methods of wireless communication in hearing assistance devices which create symmetrical (L/R) antenna performance with physically asymmetrical antenna designs.

20 Claims, 7 Drawing Sheets

HEARING AID ANTENNA WITH SYMMETRICAL PERFORMANCE

CLAIM OF PRIORITY

This patent application claims the benefit of U.S. Provisional Patent Application No. 62/113,863, filed Feb. 9, 2015, entitled "HEARING AID ANTENNA WITH SYMMETRICAL PERFORMANCE", which is incorporated by reference herein in full.

BACKGROUND

Hearing assistance devices are devices which are designed to amplify sound for a person who is hearing impaired. In some examples, audio sensed by a microphone of the hearing assistance device is amplified and output to a speaker of the hearing assistance device.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

To support wireless communications between hearing assistance devices and other devices such as cell phones and fitting devices, hearing assistance devices sometimes incorporate one or more antennas into the hearing assistance device. In some examples, hearing assistance devices (hearing aids) may be used for a left ear or a right ear. Typically, the design and production of the hearing assistance devices do not significantly differ depending on whether the device is intended for the right or left ear. The designer of the hearing assistance device therefore attempts to design the antenna such that it will operate well on both the left and right ears. This is typically very difficult to do and usually results in better antenna performance when worn on one ear as opposed to the other ear.

Left/Right (L/R) hearing assistance device (HA) symmetrical performance of the antenna is highly desired when using the same HA design for both the left and the right ears. Physical symmetry and loading of the antenna, both internal and external to the HA, is usually not possible because the antenna must avoid the microphone, battery, and switch locations within the HA.

Disclosed in some examples are antenna structures, hearing assistance devices with integrated antennas, and methods of wireless communication in hearing assistance devices which create symmetrical (L/R) antenna performance with physically asymmetrical antenna designs.

In the embodiments described below, reference is made to a hearing assistance device or hearing assistance device housing having superior and inferior ends which refers to anatomical position of the ends when the device is worn by a user. Superior and inferior ends or directions may also be referred to as top and bottom, respectively. The device or device housing also has opposite lateral sides, one facing the user's head and the other facing the pinna of the user's ear.

Figure 1A:
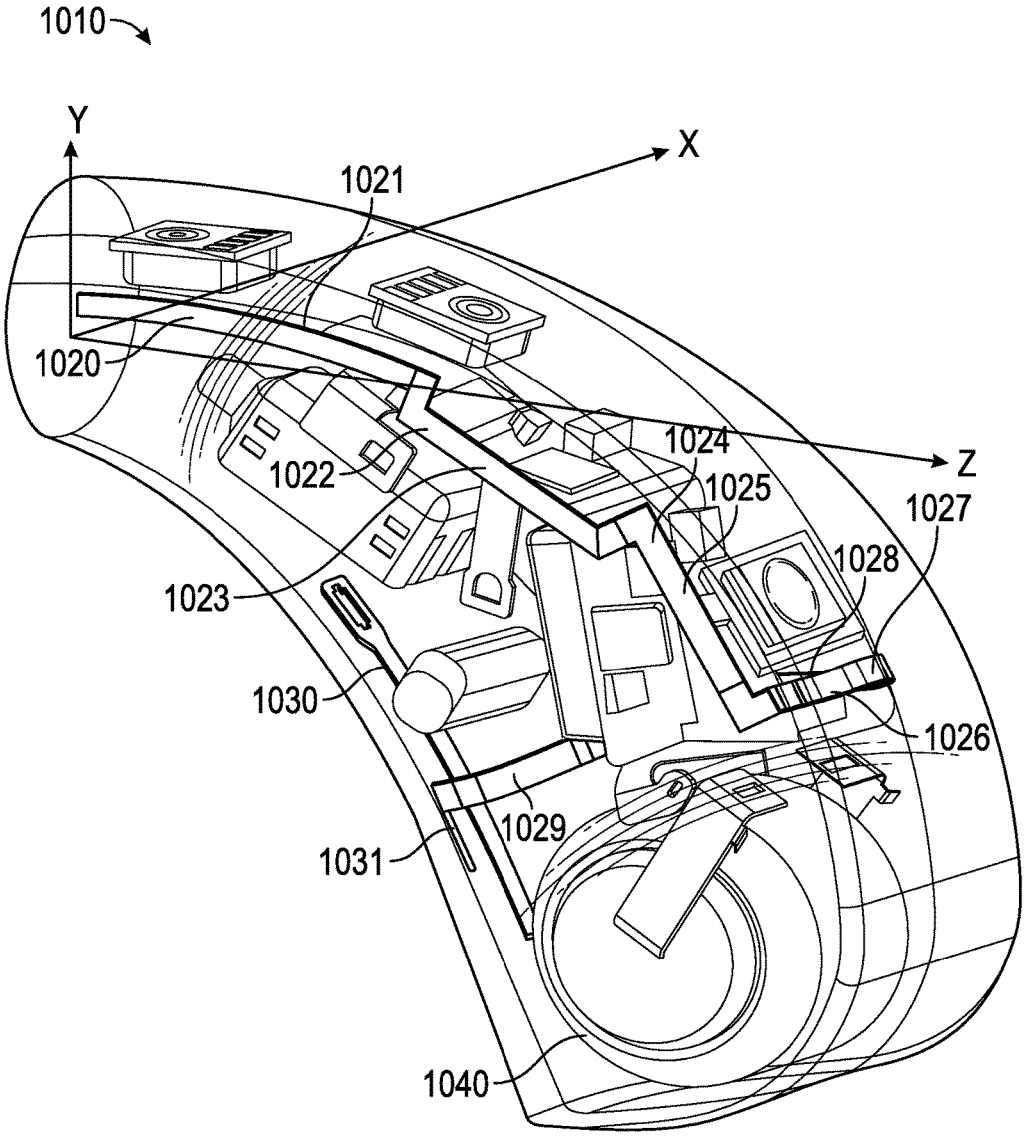
FIG. 1A shows a side view schematic of a hearing assistance device with an integrated antenna according to some examples of the present disclosure.
Figure 1B:
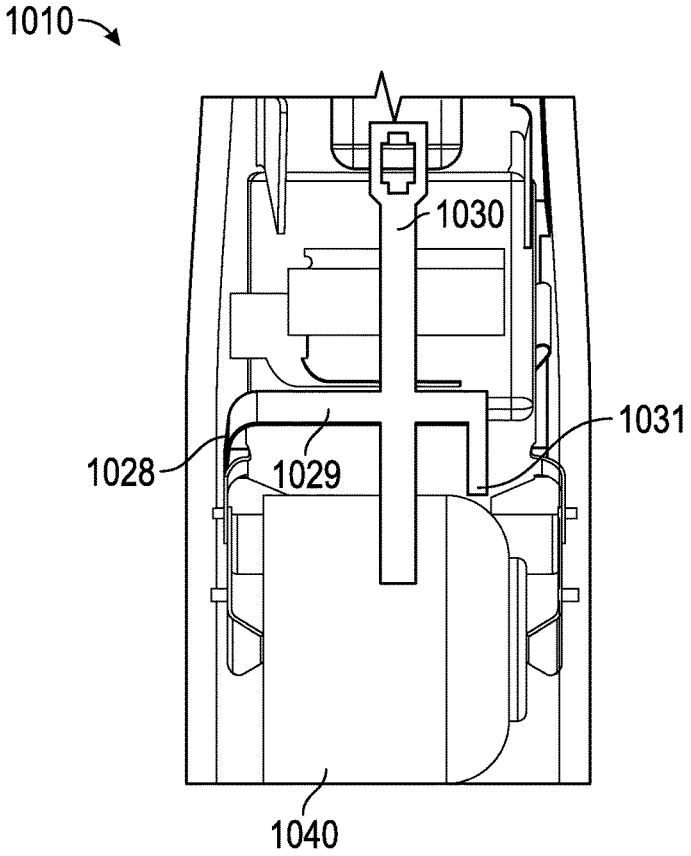
FIG. 1B shows a bottom view schematic of a hearing assistance device with an integrated antenna according to some examples of the present disclosure.

FIG. 1A shows a side view and FIG. 1B shows a bottom view schematic of a hearing assistance device housing 1010 with an integrated antenna disposed within according to some examples of the present disclosure. Antenna 1020 is a winding and slightly folded dipole antenna with a 90 degree bend, branching, and extension of the lower leg of the dipole in the direction of the hearing aid battery 1040. Antenna 1020 includes sections 1021-1031.

The antenna 1020 includes a first arcuate section 1021. Arcuate section 1021 is terminated with an elbow section 1022 which bends downward. Elbow section 1022 is connected to relatively straight section 1023. Tilted section 1024 is connected to straight section 1023 and bends over in the x-direction. Straight section 1025 continues towards the rear of the device and connects with crossing section 1026. Crossing section 1026 substantially crosses the width of the hearing assistance device 1010 and runs perpendicular to the z, y plane and over the electronic components of the hearing assistance device on the top of the device to the far side of the device. Crossing section 1026 dips downward slightly and connects with downward curved section 1027 on the backside of the device (as determined from the viewpoint of FIG. 1A). Downward curved section 1027 curves the antenna down toward the bottom of the device on the backside of the device. Angled portion 1028 then angles the antenna down towards the bottom and away from the battery 1040. Bottom flat section 1029 terminates the angled portion 1028 and curves to run along the bottom of the device. Bottom leg 1030 is perpendicularly attached to the bottom section 1029 and includes a long section forward of bottom flat section 1029 and a shorter section aft of the bottom section 1029. Smaller elbow 1031 terminates bottom flat section 1029 with an elbow aft towards the battery 1040.

Antenna 1020 includes one or more feed points to one or more excitation devices, such as a Bluetooth transceiver, Wi-Fi transceiver, a Cellular (e.g., Long Term Evolution) transceiver or a transceiver for other wireless protocols. For example, an attachment at 1026.

In some examples, the efficiency of the hearing assistance device, with the worst case performance on a user's head (from a left ear vs. right ear perspective) was improved by 3 dB. This serves to effectively equalize the performance of the HA antenna efficiency when operated on the left ear compared with operation on the right ear. The antenna improves the poorly performing ear while keeping the better performing ear relatively constant. In some examples, this performance increase was seen as a result of dielectric loading and/or metallic coupling.

Symmetrical Performance Due to Dielectric Loading

Figure 2:
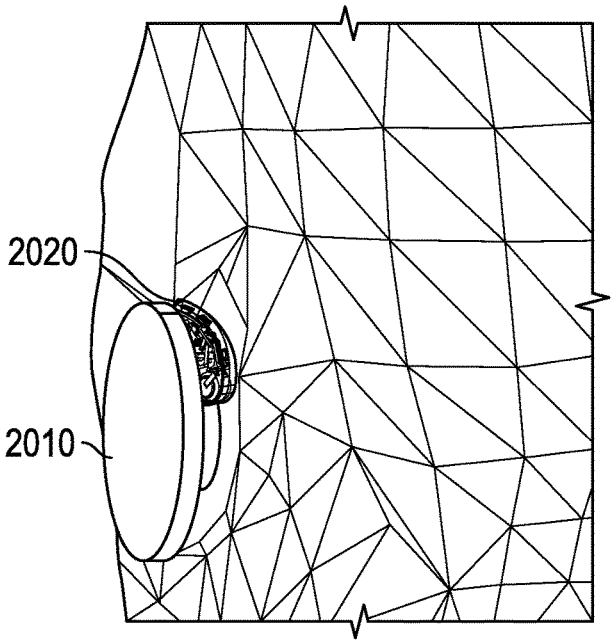
FIG. 2 shows a view of the placement of the hearing assistance device on a human according to some examples of the present disclosure.

Turning now to FIG. 2, the human ear 2010 is in contact or close proximity to the sides of the hearing aid 2020 (FIG. 2). Routing the dipole antenna in those regions of the hearing aid yields a more symmetric left/right ear wireless performance (TX and RX).

Figure 3B:
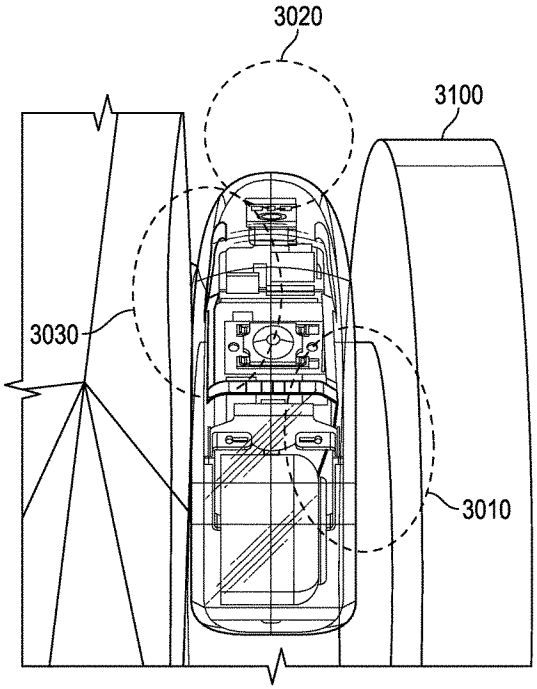
FIG. 3B shows an overhead view of the placement of the hearing assistance device on a right ear of a human according to some examples of the present disclosure.
Figure 3A:
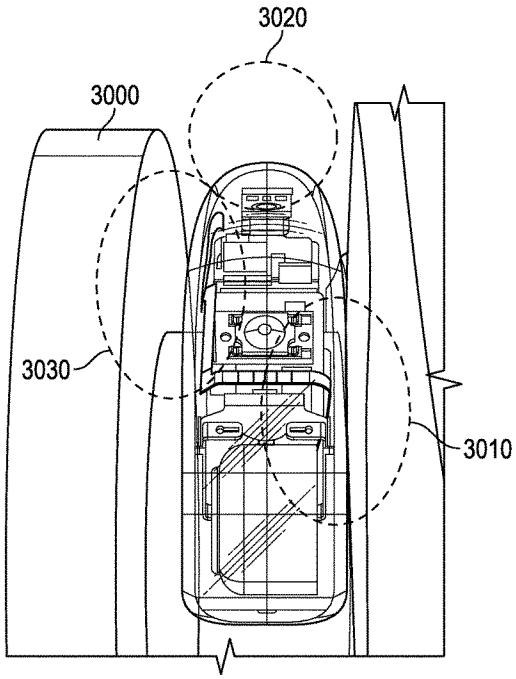
FIG. 3A shows an overhead view of the placement of the hearing assistance device on a left ear of a human according to some examples of the present disclosure.

FIGS. 3A and 3B shows the antenna in a hearing assistance device on both left 3000 and right 3100 ears. The bottom leg (within circle 3010) may see different effective permittivities on the left and right due to the difference in human body properties (ear vs. side of head). This change in effective permittivity of the bottom leg results in a change in electrical length/impedance and thus current. If the top leg of the dipole was routed on top of the HA (within circle 3020) and has similar conductor width to the bottom leg, the current on the bottom leg will change due to its change in electrical length/impedance. The current distribution which is proportional to the far-field electric field will vary based on the effective permittivity and may make it more sensitive to the differences in material properties.

Now, if the top leg (within circle 3030) is routed on the side of the hearing aid the change in electrical length/impedance due to being placed on the left or right is closer to the change in impedance on the bottom leg. This may result in a more symmetric current distribution on the antenna and thus may make it less sensitive to left versus right ear placement.

Symmetrical (L/R) Performance Due to Metallic Coupling

Figure 4:
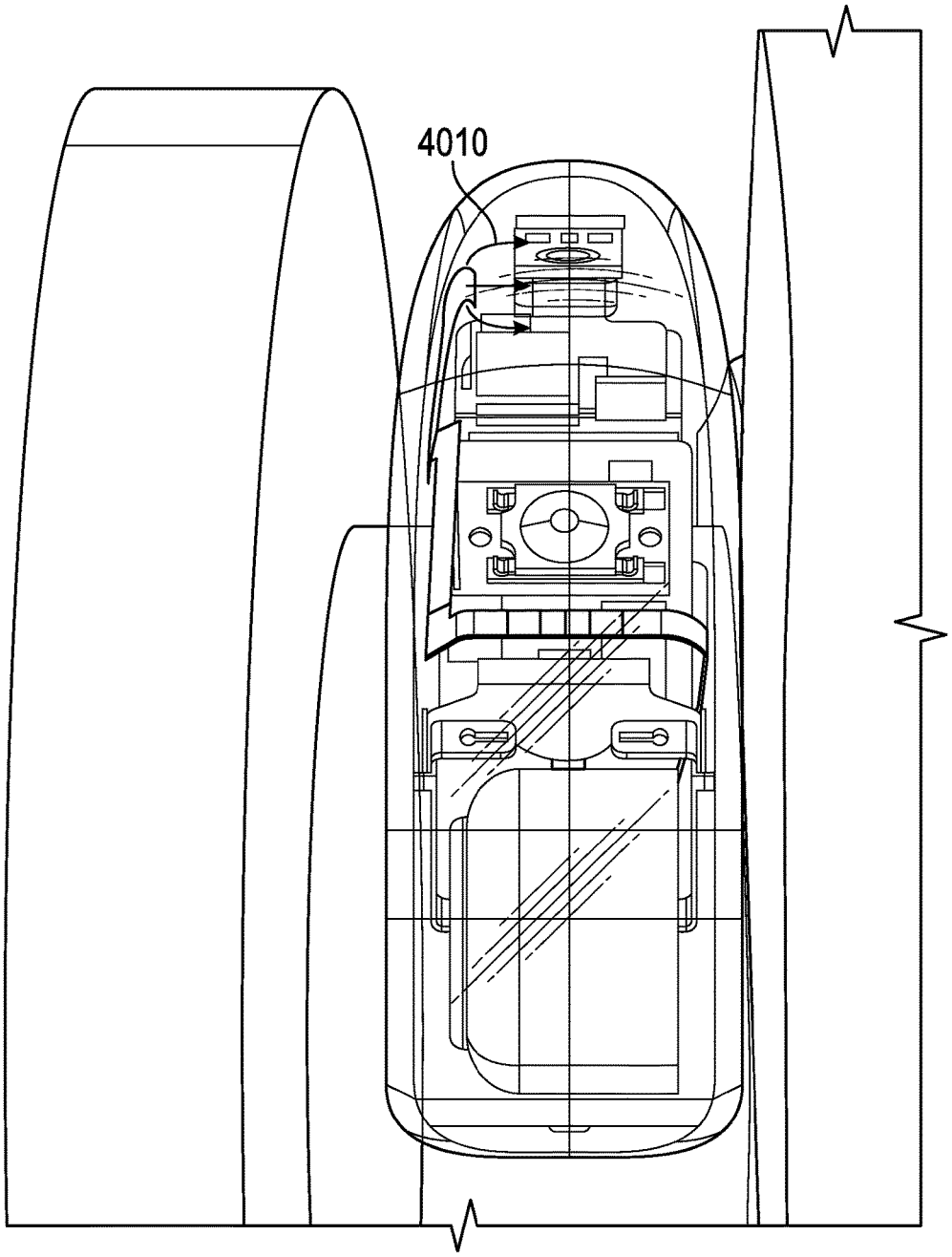
FIG. 4 shows an overhead view of the placement of the hearing assistance device on a left ear of a human according to some examples of the present disclosure.

When a metallic object of a different potential is placed in proximity to the antenna, the electric field will be more concentrated in that region. Since more of the electric field is concentrated in this region there is less variability due to environmental (e.g. left vs. right ear placement) changes outside the hearing aid. FIG. 4 demonstrates this concentration 4010.

OTHER EMBODIMENTS

Figure 6:
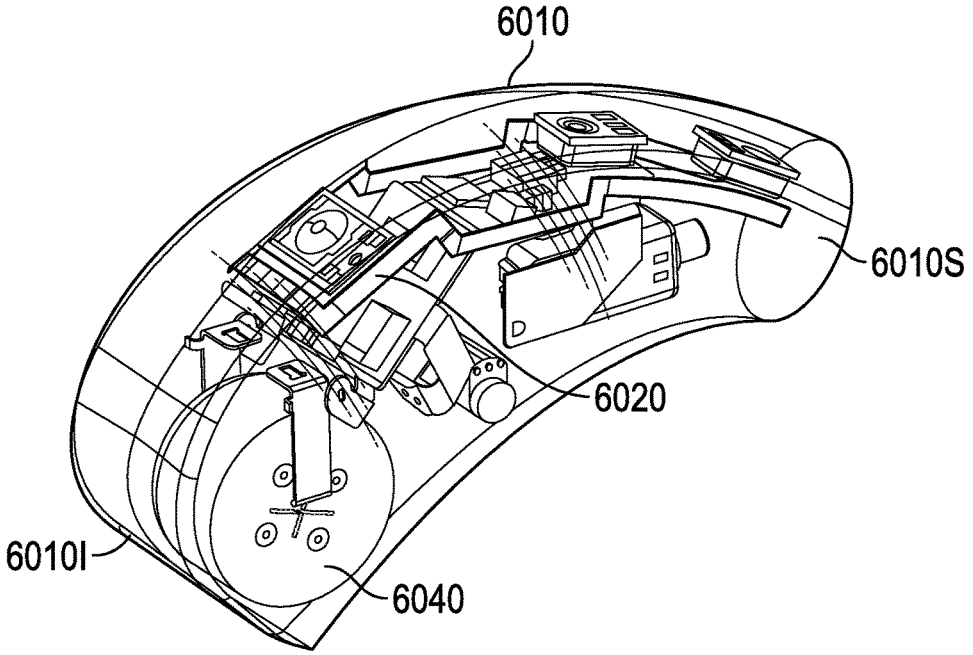
FIGS. 6-9 show different embodiments of an antenna structure within a hearing assistance device housing.

FIG. 6 shows a hearing assistance device housing 6010 having an antenna 6020 disposed within that has two symmetric legs that extend from the inferior end 6010I of the housing to the superior end 6010S on each lateral side of the housing. In order to avoid loading due to the groove of head and ear, the antenna may not be routed towards the inferior end 6010I of the HA. The antenna 6020 is also located superiorly or in front of battery 6040. Extending the legs of the antenna increases the electrical length and improves real impedance and matching capability.

Figure 7:
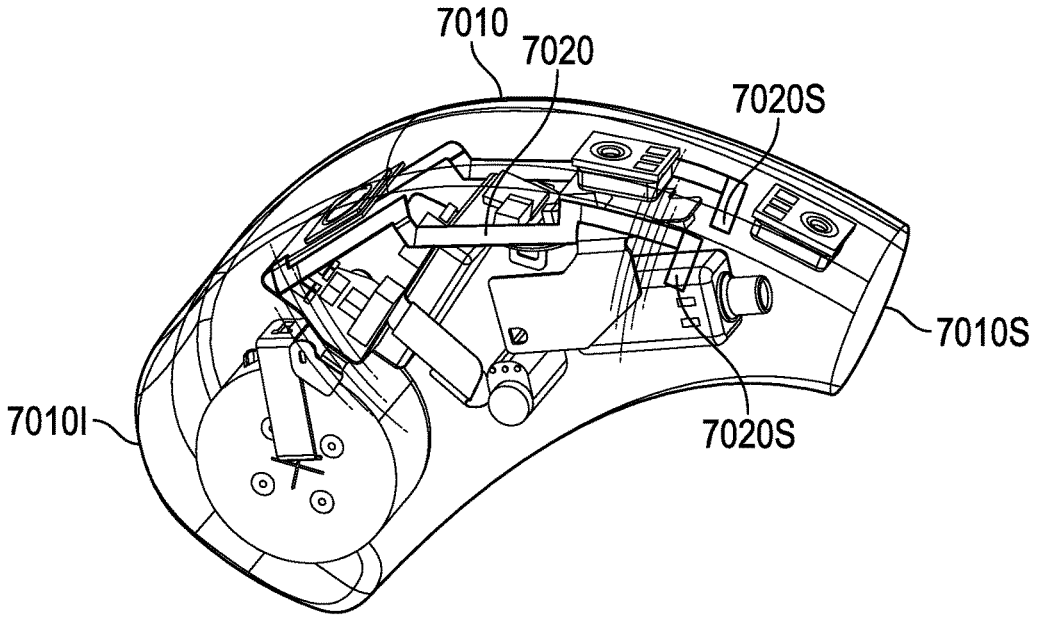

FIG. 7 shows a hearing assistance device housing 7010 having an antenna 7020 disposed within that has two symmetric legs that extend from the inferior end 7010I of the housing to the superior end 7010S on each lateral side of the housing and with tuning stubs 7020S added to each end of the antenna legs. In other embodiments, one or more stubs may be provided on one or both of the antenna legs. The stubs are useful for tuning the antenna for optimum performance.

Figure 8:
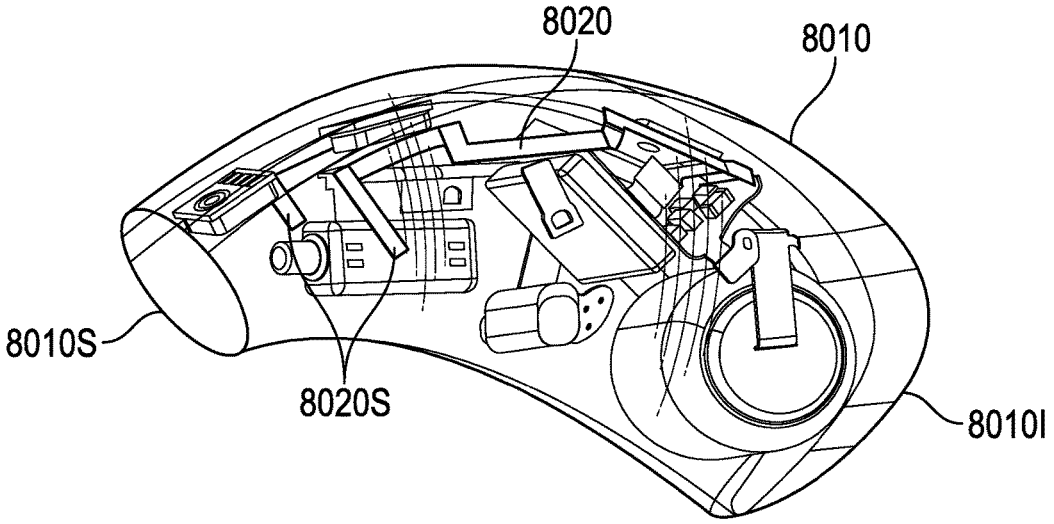

FIG. 8 shows a hearing assistance device housing 8010 having an antenna 8020 disposed within that has two symmetric legs that extend from the inferior end 8010I of the housing to the superior end 8010S on each lateral side of the housing and with tuning stubs 8020S added to each end of the antenna legs. In this embodiment, the tuning stubs 8020S are of unequal length. When hearing assistance devices are placed on each side of a person's head, balance between the antennas of each such device can be achieved by appropriate tuning.

Figure 9:
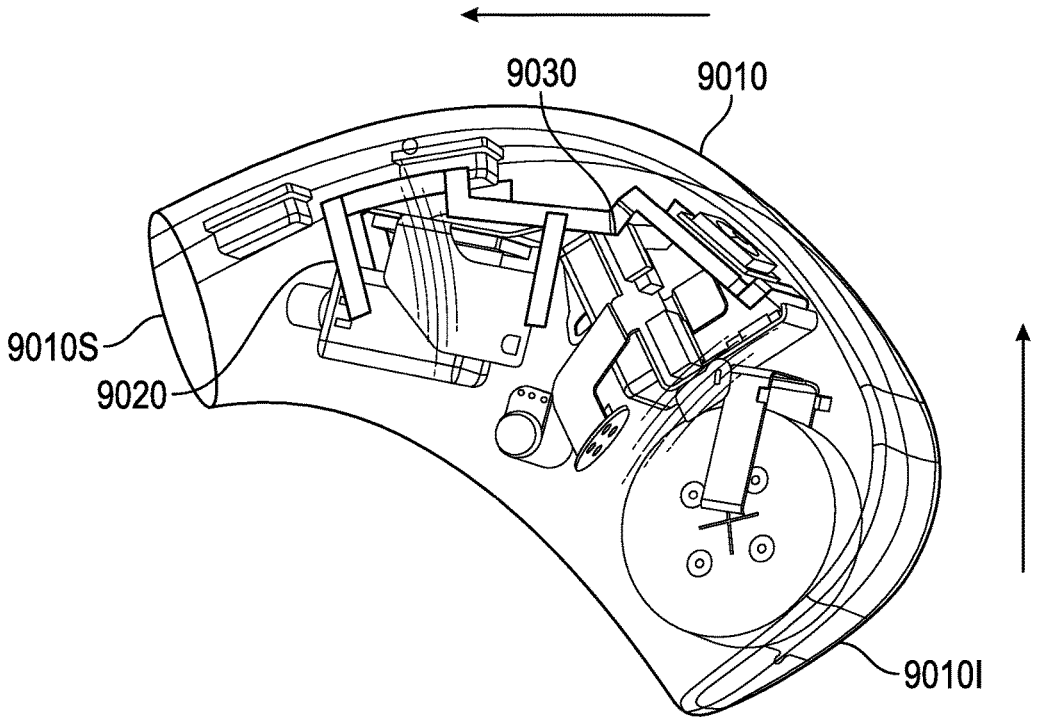

FIG. 9 shows a hearing assistance device housing 9010 having an antenna 9020 disposed within that has two symmetric legs that extend from the inferior end 9010I of the housing to the superior end 9010S on each lateral side of the housing The antenna performs better if the antenna is located toward the superior end of the housing so that it is out of the head pinna groove. This results in less loading on the antenna feeds. The antenna also performs better if the feed point 9030 is located along curvature of the superior portion housing (towards the face when the device is worn) so that the antenna suffers from lesser head loss. A balance may be struck between moving the feed point forward while maintaining a desired minimum electrical length.

Example Embodiments

In Example 1, a hearing assistance device comprises: a housing adapted to be worn behind a user's ear, the housing having superior and inferior portions when worn by the user; a wireless transceiver disposed within the housing; an antenna connected at a feedpoint to the wireless transceiver; and, wherein the antenna has a section that traverses laterally from one side of the housing to the other and a vertical section that traverses vertically within the housing. In one embodiment the feedpoint is located in the superior portion of the housing. In one embodiment, the vertical section traverses vertically toward the superior end of the housing. In one embodiment the feedpoint is located in the inferior portion of the housing. In one embodiment, the vertical section traverses vertically toward the inferior end of the housing.

In Example 2, the subject matter of any of the Examples herein may further comprise wherein the antenna has one or more legs that extend vertically toward the superior portion of the housing.

In Example 3, the subject matter of any of the Examples herein may further comprise wherein the antenna has two symmetric legs that extend from the inferior end of the housing to the superior end of the housing on each lateral side of the housing.

In Example 4, the subject matter of any of the Examples herein may further comprise wherein the antenna has tuning stubs at each end of the antenna legs.

In Example 5, the subject matter of any of the Examples herein may further comprise wherein the antenna has one or more stubs are located on one or both of the antenna legs.

In Example 6, the subject matter of any of the Examples herein may further comprise wherein the antenna has tuning stubs of unequal length at each end of the antenna legs.

In Example 7, the subject matter of any of the Examples herein may further comprise wherein the antenna has tuning stubs of equal length at each end of the antenna legs.

In Example 8, the subject matter of any of the Examples herein may further comprise wherein the feedpoint for the antenna is located in an arcuate portion of the housing at the superior end.

In Example 9, the subject matter of any of the Examples herein may further comprise wherein the hearing assistance device is a behind-the-ear (BTE) hearing aid.

In Example 10, the subject matter of any of the Examples herein may further comprise wherein the hearing assistance device is a receiver-in-canal (RIC) hearing aid.

In Example 11, the subject matter of any of the Examples herein may further comprise wherein the antenna is located superiorly, or in front of, a battery contained within the housing.

In Example 12, the subject matter of any of the Examples herein may further comprise wherein the antenna is a loop antenna closed at the end opposite the feedpoint.

In Example 13, a method comprises constructing a hearing assistance device as recited in any of the Examples herein.

Hearing assistance devices typically include at least one enclosure or housing, a microphone, hearing assistance device electronics including processing electronics, and a speaker or "receiver." In some examples, hearing assistance devices may include an antenna for wireless communication. Hearing assistance devices may include a power source, such as a battery. In various embodiments, the battery may be rechargeable. In various embodiments multiple energy sources may be employed. It is understood that in various embodiments the microphone is optional. It is understood that in various embodiments the receiver is optional. It is understood that variations in communications protocols, antenna configurations, and combinations of components may be employed without departing from the scope of the present subject matter. Antenna configurations may vary and may be included within an enclosure for the electronics or be external to an enclosure for the electronics. Thus, the examples set forth herein are intended to be demonstrative and not a limiting or exhaustive depiction of variations.

It is understood that hearing assistance devices may be digital hearing aids. It is understood that digital hearing aids include a processor. In digital hearing aids with a processor, programmable gains may be employed to adjust the hearing aid output to a wearer's particular hearing impairment. The processor may be a digital signal processor (DSP), microprocessor, microcontroller, other digital logic, or combinations thereof. The processing may be done by a single processor, or may be distributed over different devices. The processing of signals referenced in this application can be performed using the processor or over different devices. Processing may be done in the digital domain, the analog domain, or combinations thereof. Processing may be done using subband processing techniques. Processing may be done using frequency domain or time domain approaches. Some processing may involve both frequency and time domain aspects. For brevity, in some examples drawings may omit certain blocks that perform frequency synthesis, frequency analysis, analog-to-digital conversion, digital-to-analog conversion, amplification, buffering, and certain types of filtering and processing. In various embodiments the processor is adapted to perform instructions stored in one or more memories, which may or may not be explicitly shown. Various types of memory may be used, including volatile and nonvolatile forms of memory. In various embodiments, the processor or other processing devices execute instructions to perform a number of signal processing tasks. Such embodiments may include analog components in communication with the processor to perform signal processing tasks, such as sound reception by a microphone, or playing of sound using a receiver (i.e., in applications where such transducers are used). In various embodiments, different realizations of the block diagrams, circuits, and processes set forth herein can be created by one of skill in the art without departing from the scope of the present subject matter.

Various embodiments of the present subject matter support wireless communications with a hearing assistance device. In various embodiments the wireless communications can operate according to one or more_standard or nonstandard communications protocols. Some examples of standard wireless communications protocols include, but are not limited to, Bluetooth™, low energy Bluetooth, an Institute for Electrical and Electronics Engineers (IEEE) 802.11 (wireless LANs) family of standards, an IEEE 802.15 (WPANs) family of standards, an IEEE_802.16 (WiMAX) family of standards, a Long Term Evolution (LTE) family of standards defined by the Third Generation Partnership Project (3GPP), a Universal Mobile Telecommunications (UMTS) family of standards defined by 3GPP, a Global System for Mobile Communications (GSM) family of standards, Zigbee, and the like.

In various embodiments, the communications are radio frequency communications. In various embodiments the communications are optical communications, such as infrared communications. In various embodiments, the communications are inductive communications. In various embodiments, the communications are ultrasound communications. Although embodiments of the present system may be demonstrated as radio communication systems, it is possible that other forms of wireless communications can be used. It is understood that past and present standards can be used. It is also contemplated that future versions of these standards and new future standards may be employed without departing from the scope of the present subject matter.

In various embodiments, the present subject matter is used in hearing assistance devices that are configured to communicate with mobile phones. In such embodiments, the hearing assistance device may be operable to perform one or more of the following: answer incoming calls, hang up on calls, and/or provide two way telephone communications. In various embodiments, the present subject matter is used in hearing assistance devices configured to communicate with packet-based devices. In various embodiments, the present subject matter includes hearing assistance devices configured to communicate with streaming audio devices. In various embodiments, the present subject matter includes hearing assistance devices configured to communicate with Wi-Fi devices. In various embodiments, the present subject matter includes hearing assistance devices capable of being controlled by remote control devices.

It is further understood that different hearing assistance devices may embody the present subject matter without departing from the scope of the present disclosure. The devices depicted in the figures are intended to demonstrate the subject matter, but not necessarily in a limited, exhaustive, or exclusive sense. It is also understood that the present subject matter can be used with a device designed for use in the right ear or the left ear or both ears of the wearer.

The present subject matter may be employed in hearing assistance devices, such as headsets, headphones, and similar hearing devices.

The present subject matter may be employed in hearing assistance devices having additional sensors. Such sensors include, but are not limited to, magnetic field sensors, telecoils, temperature sensors, accelerometers and proximity sensors.

The present subject matter is demonstrated for hearing assistance devices, including hearing aids, including but not limited to, behind-the-ear (BTE), in-the-ear (ITE), in-the-canal (ITC), receiver-in-canal (RIC), or completely-in-the-canal (CIC) type hearing aids. It is understood that behind-the-ear type hearing aids may include devices that reside substantially behind the ear or over the ear. Such devices may include hearing aids with receivers associated with the electronics portion of the behind-the-ear device, or hearing aids of the type having receivers in the ear canal of the user, including but not limited to receiver-in-canal (RIC) or receiver-in-the-ear (RITE) designs. The present subject matter can also be used in hearing assistance devices generally, such as cochlear implant type hearing devices and such as deep insertion devices having a transducer, such as a receiver or microphone, whether custom fitted, standard fitted, open fitted and/or occlusive fitted. It is understood that other hearing assistance devices not expressly stated herein may be used in conjunction with the present subject matter.

Figure 5:
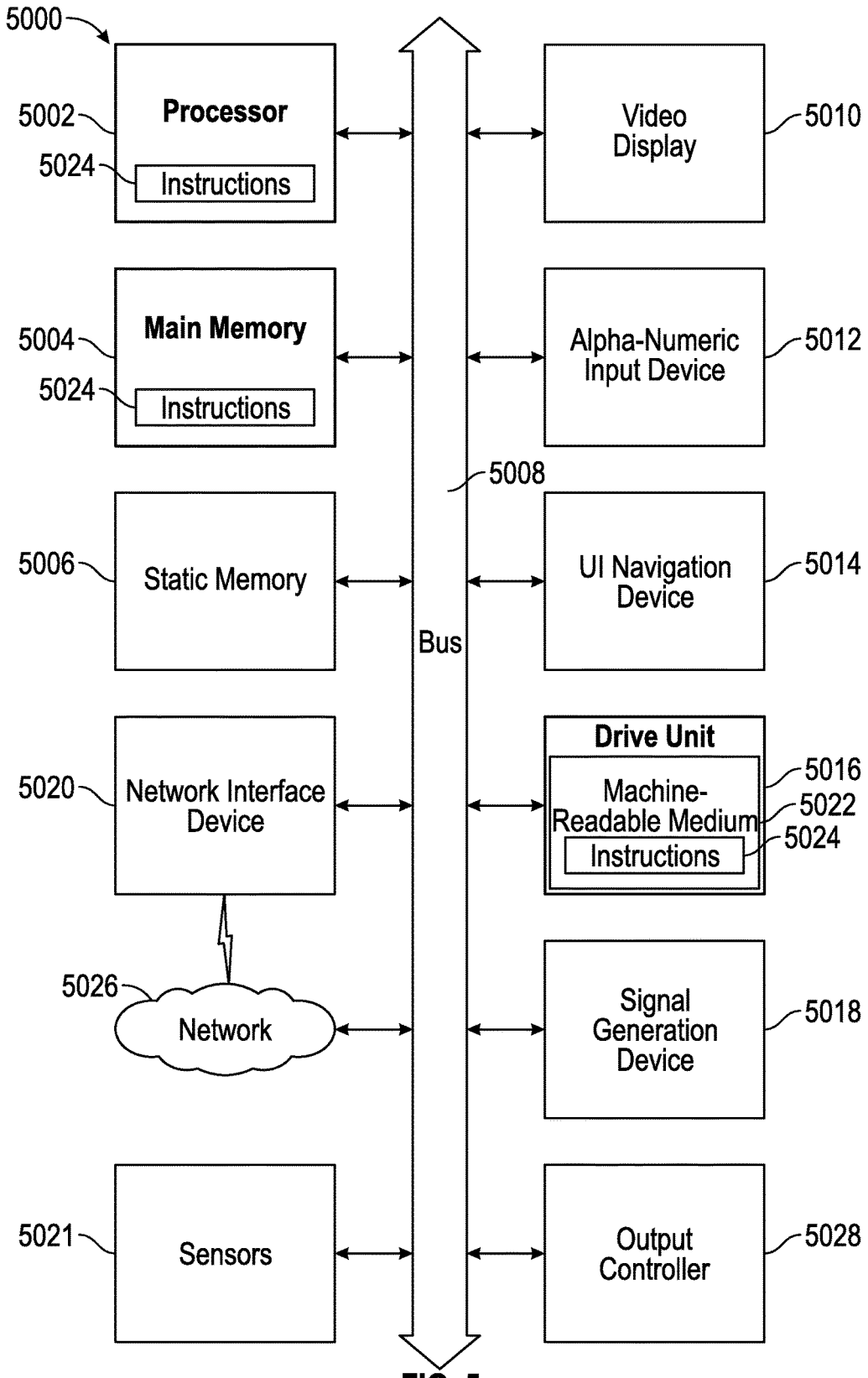
FIG. 5 is a block diagram illustrating an example of a machine upon which one or more embodiments may be implemented.

FIG. 5 illustrates a block diagram of an example machine 5000 upon which any one or more of the techniques (e.g., methodologies) discussed herein may perform. In alternative embodiments, the machine 5000 may operate as a standalone device or may be connected (e.g., networked) to other machines. In a networked deployment, the machine 5000 may operate in the capacity of a server machine, a client machine, or both in server-client network environments. In an example, the machine 5000 may act as a peer machine in peer-to-peer (P2P) (or other distributed) network environment. The machine 5000 may be a hearing assistance device, a hearing assistance device programming device, a personal computer (PC), a tablet PC, a set-top box (STB), a personal digital assistant (PDA), a mobile telephone, a smart phone, a web appliance, a network router, switch or bridge, or any machine capable of executing instructions (sequential or otherwise) that specify actions to be taken by that machine. Further, while only a single machine is illustrated, the term "machine" shall also be taken to include any collection of machines that individually or jointly execute a set (or multiple sets) of instructions to perform any one or more of the methodologies discussed herein, such as cloud computing, software as a service (SaaS), other computer cluster configurations.

Examples, as described herein, may include, or may operate on, logic or a number of components, hardware circuits, modules, or mechanisms. Hardware circuits, e.g., modules, are tangible entities (e.g., hardware) capable of performing specified operations and may be configured or arranged in a certain manner. In an example, circuits may be arranged (e.g., internally or with respect to external entities such as other circuits) in a specified manner as a module. In an example, the whole or part of one or more computer systems (e.g., a standalone, client or server computer system) or one or more hardware processors may be configured by firmware or software (e.g., instructions, an application portion, or an application) as a module that operates to perform specified operations. In an example, the software may reside on a machine readable medium. In an example, the software, when executed by the underlying hardware of the module, causes the hardware to perform the specified operations.

Accordingly, the term "module" is understood to encompass a tangible entity, be that an entity that is physically constructed, specifically configured (e.g., hardwired), or temporarily (e.g., transitorily) configured (e.g., programmed) to operate in a specified manner or to perform part or all of any operation described herein. Considering examples in which modules are temporarily configured, each of the modules need not be instantiated at any one moment in time. For example, where the modules comprise a general-purpose hardware processor configured using software, the general-purpose hardware processor may be configured as respective different modules at different times. Software may accordingly configure a hardware processor, for example, to constitute a particular module at one instance of time and to constitute a different module at a different instance of time.

Machine (e.g., computer system) 5000 may include a hardware processor 5002 (e.g., a central processing unit (CPU), a graphics processing unit (GPU), a hardware processor core, a digital signal processor, or any combination thereof), a main memory 5004 and a static memory 5006, some or all of which may communicate with each other via an interlink (e.g., bus) 5008. The machine 5000 may further include a display unit 5010, an alphanumeric input device 5012 (e.g., a keyboard), and a user interface (UI) navigation device 5014 (e.g., a mouse). In an example, the display unit 5010, input device 5012 and UI navigation device 5014 may be a touch screen display. The machine 5000 may additionally include a storage device (e.g., drive unit) 5016, a signal generation device 5018 (e.g., a speaker), a network interface device 5020, and one or more sensors 5021, such as a global positioning system (GPS) sensor, compass, accelerometer, microphone, or other sensor. The machine 5000 may include an output controller 5028, such as a serial (e.g., universal serial bus (USB), parallel, or other wired or wireless (e.g., infrared (IR), near field communication (NFC), etc.) connection to communicate or control one or more peripheral devices (e.g., a printer, card reader, etc.).

The storage device 5016 may include a machine readable medium 5022 on which is stored one or more sets of data structures or instructions 5024 (e.g., software) embodying or utilized by any one or more of the techniques or functions described herein. The instructions 5024 may also reside, completely or at least partially, within the main memory 5004, within static memory 5006, or within the hardware processor 5002 during execution thereof by the machine 5000. In an example, one or any combination of the hardware processor 5002, the main memory 5004, the static memory 5006, or the storage device 5016 may constitute machine readable media.

While the machine readable medium 5022 is illustrated as a single medium, the term "machine readable medium" may include a single medium or multiple media (e.g., a centralized or distributed database, and/or associated caches and servers) configured to store the one or more instructions 5024.

The term "machine readable medium" may include any medium that is capable of storing, encoding, or carrying instructions for execution by the machine 5000 and that cause the machine 5000 to perform any one or more of the techniques of the present disclosure, or that is capable of storing, encoding or carrying data structures used by or associated with such instructions. Non-limiting machine readable medium examples may include solid-state memories, and optical and magnetic media. Specific examples of machine readable media may include: non-volatile memory, such as semiconductor memory devices (e.g., Electrically Programmable Read-Only Memory (EPROM), Electrically Erasable Programmable Read-Only Memory (EEPROM)) and flash memory devices; magnetic disks, such as internal hard disks and removable disks; magneto-optical disks; Random Access Memory (RAM); Solid State Drives (SSD); and CD-ROM and DVD-ROM disks. In some examples, machine readable media may include non-transitory machine readable media. In some examples, machine readable media may include machine readable media that is not a transitory propagating signal.

The instructions 5024 may further be transmitted or received over a communications network 5026 using a transmission medium via the network interface device 5020. The Machine 5000 may communicate with one or more other machines utilizing any one of a number of transfer protocols (e.g., frame relay, internet protocol (IP), transmission control protocol (TCP), user datagram protocol (UDP), hypertext transfer protocol (HTTP), etc.). Example communication networks may include a local area network (LAN), a wide area network (WAN), a packet data network (e.g., the Internet), mobile telephone networks (e.g., cellular networks), Plain Old Telephone (POTS) networks, and wireless data networks (e.g., Institute of Electrical and Electronics Engineers (IEEE) 802.11 family of standards known as Wi-Fi®, IEEE 802.16 family of standards known as WiMax®), IEEE 802.15.4 family of standards, a Long Term Evolution (LTE) family of standards, a Universal Mobile Telecommunications System (UMTS) family of standards, peer-to-peer (P2P) networks, among others. In an example, the network interface device 5020 may include one or more physical jacks (e.g., Ethernet, coaxial, or phone jacks) or one or more antennas to connect to the communications network 5026. In an example, the network interface device 5020 may include a plurality of antennas to wirelessly communicate using at least one of single-input multiple-output (SIMO), multiple-input multiple-output (MIMO), or multiple-input single-output (MISO) techniques. In some examples, the network interface device 5020 may wirelessly communicate using Multiple User MIMO techniques.

This application is intended to cover adaptations or variations of the present subject matter. It is to be understood that the above description is intended to be illustrative, and not restrictive. The scope of the present subject matter should be determined with reference to the appended claims, along with the full scope of legal equivalents to which such claims are entitled.

What is claimed is:

1. A hearing assistance device comprising:

a housing adapted to be worn behind a user's ear, the housing having superior and inferior ends and lateral sides facing toward and away from the user's head when worn by the user;

a wireless transceiver disposed within the housing;

an antenna connected at a feedpoint to the wireless transceiver;

wherein the antenna has a crossing section that traverses laterally from one lateral side of the housing to the other, a top leg that is connected to one end of the crossing section that extends vertically toward the superior end of the housing, and a bottom leg connected to the opposite end of the crossing section that extends vertically toward the inferior end of the housing; and wherein the top and bottom legs are routed on opposite lateral sides of the housing.

2. The device of claim 1 wherein the top leg includes an arcuate section at the superior end of the housing.

3. The device of claim 2 wherein the arcuate section is terminated with an elbow section that bends toward a front of the housing when worn by the user.

4. The device of claim 3 wherein the elbow section is connected to a straight section that extends inferiorly.

5. The device of claim 4 wherein the straight section is connected to the crossing section.

6. The device of claim 1 wherein the crossing section is connected to a curved section directed toward the front of the housing.

7. The device of claim 6 wherein the curved section is connected to a bottom section that is directed toward the front of the housing.

8. The device of claim 7 wherein the bottom section is perpendicularly connected to the bottom leg.

9. The device of claim 8 wherein the bottom leg includes a long section and a shorter section extending in opposite directions.

10. The device of claim 1 wherein the antenna is a dipole antenna.

11. A method for constructing a hearing assistance device comprising:

disposing a wireless transceiver within a housing adapted to be worn behind a user's ear, the housing having superior and inferior ends and lateral sides facing toward and away from the user's head when worn by the user; and, connecting an antenna at a feedpoint to the wireless transceiver;

constructing the antenna to have a crossing section traverses laterally from one side of the housing to the other, a top leg that is connected to one end of the crossing section that extends vertically toward the superior end of the housing, and a bottom leg connected to the opposite end of the crossing section that extends vertically toward the inferior end of the housing; and routing the top and bottom legs on opposite sides of the housing.

12. The method of claim 11 wherein the top leg includes an arcuate section at the superior end of the housing.

13. The method of claim 12 wherein the arcuate section is terminated with an elbow section that bends toward a front of the housing when worn by the user.

14. The method of claim 13 wherein the elbow section is connected to a straight section that extends inferiorly.

15. The method of claim 14 wherein the straight section is connected to the crossing section.

16. The method of claim 11 wherein the crossing section is connected to a curved section directed toward the front of the housing.

17. The method of claim 16 wherein the curved section is connected to a bottom section that is directed toward the front of the housing.

18. The method of claim 17 wherein the bottom section is perpendicularly connected to the bottom leg.

19. The method of claim 18 wherein the bottom leg includes a long section and a shorter section extending in opposite directions.

20. The method of claim 11 wherein the antenna is a dipole antenna.

* * * * *